US006914377B2

(12) United States Patent
Cho et al.

(10) Patent No.: US 6,914,377 B2
(45) **Date of Patent: *Jul. 5, 2005**

(54) NATURAL VIEW FLAT PANEL FOR CATHODE RAY TUBE

(75) Inventors: Yoon-hyoung Cho, Yongin-si (KR); Hyun-jung Shin, Suwon-si (KR); Do-houn Pyun, Yongin-si (KR); Kwang-sik Lee, Seongnam-si (KR); Jae-jin An, Anyang-si (KR); Won-ho Kim, Suwon-si (KR); Yong-geol Kwon, Suwon-si (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/918,634

(22) Filed: Aug. 1, 2001

(65) Prior Publication Data

US 2002/0011775 A1 Jan. 31, 2002

Related U.S. Application Data

(63) Continuation of application No. 09/724,186, filed on Nov. 27, 2000, now Pat. No. 6,459,196, which is a continuation of application No. 09/058,544, filed on Apr. 10, 1998, now Pat. No. 6,160,344.

(30) Foreign Application Priority Data

Apr. 12, 1997 (KR) ..... 97-13493
Apr. 4, 1998 (KR) ..... 98-11926

(51) Int. Cl.[7] ..... H01J 29/10
(52) U.S. Cl. ..... 313/461; 313/477 R; 220/2.1 A
(58) Field of Search ..... 313/477 R, 402, 313/461, 473; 220/2.1 A, 2.1 R, 2.3 A

(56) References Cited

U.S. PATENT DOCUMENTS 4,537,321 A 8/1985 Tokita
4,537,322 A 8/1985 Okada et al.
4,580,077 A 4/1986 Bakker et al.
4,924,140 A 5/1990 Hirai et al.
4,985,658 A 1/1991 Canevazzi
5,107,999 A 4/1992 Canevazzi
5,155,410 A 10/1992 Wakasono et al.
5,216,321 A 6/1993 Kawamura et al.
5,386,174 A 1/1995 Ishii
5,814,933 A 9/1998 Iwata et al.
6,016,028 A * 1/2000 Iguchi et al. ..... 313/477 R
6,133,686 A 10/2000 Inoue et al.

FOREIGN PATENT DOCUMENTS

JP 6-36710 2/1994
JP 6-44926 2/1994

* cited by examiner

*Primary Examiner*—Ashok Patel
(74) *Attorney, Agent, or Firm*—Lee, Sterba & Morse, P.C.

(57) ABSTRACT

A flat panel for a cathode ray tube for preventing a screen image from being shown concavely to a user or viewer includes a flat outer surface and a non-spherically formed inner surface, the non-spherically formed inner surface satisfying formula 1:

$$y_1 \leqq y_2 \quad \text{(formula 1)}$$

wherein $y_1$ represents a vertical distance between the outer surface and a refracted screen image on a central axis of the panel, and $y_2$ represents a vertical distance between the outer surface and the refracted screen image in peripheral areas other than the central axis of the panel, and the panel has a high transmission ratio equal to or greater than about 60% for preventing degradation of luminance due to a difference in thickness between a central section and a peripheral section of the panel.

2 Claims, 3 Drawing Sheets

NATURAL VIEW FLAT PANEL FOR CATHODE RAY TUBE

This application is a continuation application of U.S. application Ser. No. 09/724,186 filed Nov. 27, 2000, now U.S. Pat. No. 6,459,196 B1, issued Oct. 1, 2002, which is a continuation of U.S. application Ser. No. 09/058,544 filed Apr. 10, 1998, now U.S. Pat. No. 6,160,344, issued Dec. 12, 2000.

BACKGROUND OF THE INVENTION

1. Field of the Invention

The present invention relates to a panel for a cathode ray tube and, more particularly, to a flat panel for a cathode ray tube in which external light reflection is minimized, appearance is improved, natural view of screen images is possible, and to which a shadow mask may be applied.

2. Description of the Related Art

In general, a cathode ray tube includes a phosphor screen applied with three colors, red, green and blue, a shadow mask for selecting colors, an electron gun for emitting electron beams, and a deflection yoke for deflecting the electron beams on the phosphor screen, wherein the electron beams for the three colors, red, green and blue, reach respective phosphor substances passing through apertures formed on the shadow mask to form desired images on a front panel of the cathode ray tube.

The phosphor screen coated with the phosphor substances is provided on an inner surface of a panel forming a body part of the cathode ray tube with a funnel, wherein the panel is usually formed with a curved inner surface and a curved outer surface using a transparent glass plate.

Such prior art panels, however, have limitations in terms of undesirable reflection of external light and distortion of the screen image as the outer surface is not flat. The current trend, therefore, is to move towards a flat panel wherein an outer surface is formed flat.

As shown in FIG. 3, such a flat panel employs typically a panel 30, of which both the inner and outer surfaces 31, 32 are formed flat, and a flat tension mask 33 having good tension force in both the horizontal and vertical directions for minimizing the degradation of screen quality due to a so-called "doming" phenomenon.

Further, a panel, of which an outer surface is formed flat and an inner surface has a curvature only in the horizontal direction, is utilized, wherein the panel employs an aperture grill which is applied with a tension force in the vertical direction in consideration of the the flat inner surface.

FIG. 4 shows a screen image 35 displayed to a user U at a distance apart from the flat panel 30, the distance being a function of the width of a screen. In FIG. 4, the screen image 35 which is substantially realized on an inner surface 32 of the flat panel 30 along sight or eye line E is refracted while passing through the outer surface and is seen by the user U as if the screen image is positioned between the outer surface 31 and the inner surface 32 of the panel 30.

Such a conventional flat panel 30, however, has a disadvantage in that a natural screen image may not be realized due to a screen distortion phenomenon wherein the screen image appears to be concave inwardly as the size of the panel increases due to the refraction of the screen image along the sight or eye line as it passes through the flat panel 30.

Further, the color selection function becomes limited to the flat tension mask or the aperture grill forming a mask surface by the tension force, so that it is impossible to compatibly use the flat panel in an existing cathode ray tube having a shadow mask.

SUMMARY OF THE INVENTION

Accordingly, the present invention is directed to a flat panel that substantially eliminates one or more of the problems due to limitations and disadvantages of the related art.

A feature of an embodiment of the present invention is to provide a flat panel for a cathode ray tube in which a screen image may be realized on the flat panel without appearing concave.

Another feature of an embodiment of the present invention is to provide a flat panel for a cathode ray tube that displays a screen image that does not appear concave and which flat panel is capable of using existing masks to achieve such visual effect.

To achieve these and other features of the present invention and in accordance with the purpose, intent and spirit of the present invention, as embodied and broadly described herein, there is provided a flat panel for a cathode ray tube comprising an outer surface having a flat configuration, and an inner surface having a non-spherical, convexly curved configuration relative to the outer surface and satisfying formula 1, $$Y_1 \leqq Y_2 \qquad \text{(formula 1)}$$

wherein $Y_1$ represents a vertical distance between the outer surface and a refracted screen image along a central axis of the panel, and $Y_2$ represents a vertical distance between the outer surface and the refracted screen image in peripheral areas other than the central axis of the panel 20.

In another embodiment of the present invention, there is provided a cathode ray tube comprising a funnel having a neck part and an opening part, an electron gun provided at a front end portion of the neck part in the funnel for emitting electron beams, a deflection yoke for deflecting the electron beams emitted from the electron gun, a shadow mask for discriminating the electron beams deflected by the deflection yoke, and a panel coupled in the opening part of the funnel and provided with a phosphor surface inside for realizing a screen image by the electron beams discriminated by the shadow mask, the panel comprising:

an outer surface having a flat configuration; and an inner surface having a non-spherical, convexly curved configuration relative to the outer surface and satisfying formula 1, $$Y_1 \leqq Y_2 \qquad \text{(formula 1)}$$

wherein $Y_1$ represents a vertical distance between the outer surface and a refracted screen image along a central axis of the panel, and $Y_2$ represents a vertical distance between the outer surface and the refracted screen image in peripheral areas other than the central axis of the panel.

The panel has a high transmission ratio of 60% or more for preventing the degradation of luminance due to a difference in thickness between the central area and the peripheral area.

In the flat panel for a cathode ray tube of the present invention, the outer surface minimizes external light reflection and improves the display and appearance of screen images, and the inner surface allows the realization of natural images by preventing screen distortion due to the refraction of the screen image while passing through the flat panel.

BRIEF DESCRIPTION OF THE DRAWINGS

The accompanying drawings, which are included to provide a further understanding of the invention and are incorporated in and constitute a part of this specification, illustrate a preferred embodiment of the invention and together with the description serve to explain the principles of the invention.

DETAILED DESCRIPTION OF THE PREFERRED EMBODIMENTS

Reference will now be made in detail to a preferred embodiment of the present invention, examples of which are illustrated in the accompanying drawings.

Figure 1:
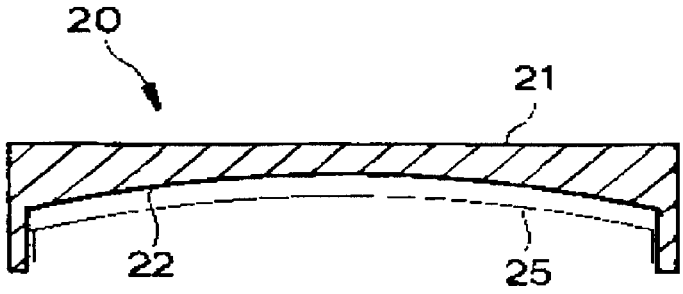
FIG. 1 is a cross-sectional view showing a flat panel for a cathode ray tube according to a preferred embodiment of the present invention.
Figure 2:
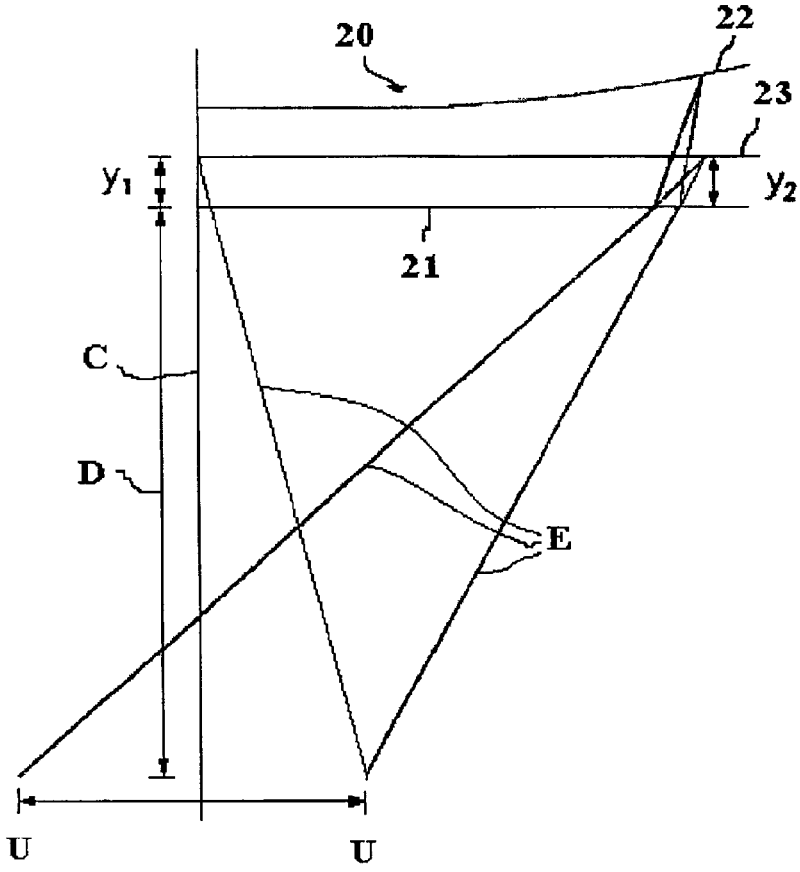
FIG. 2 is a schematic view showing a relationship between a screen image realized on the inner and outer surfaces of the flat panel for a cathode ray tube and a virtual screen image with respect to a viewer's or user's line of vision or sight according to the present invention.
Figure 3:
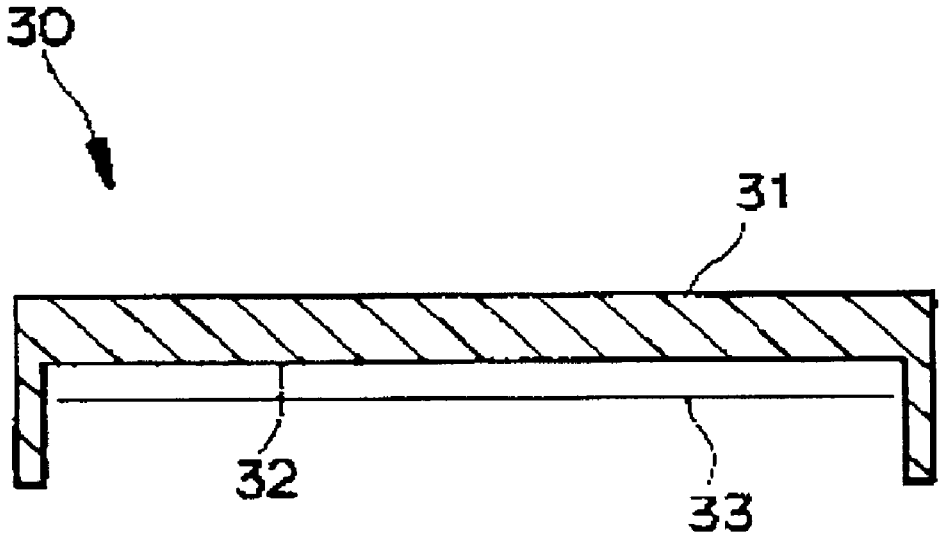
FIG. 3 is a cross-sectional view showing a prior art panel, of which inner and outer surfaces are formed flat.
Figure 4:
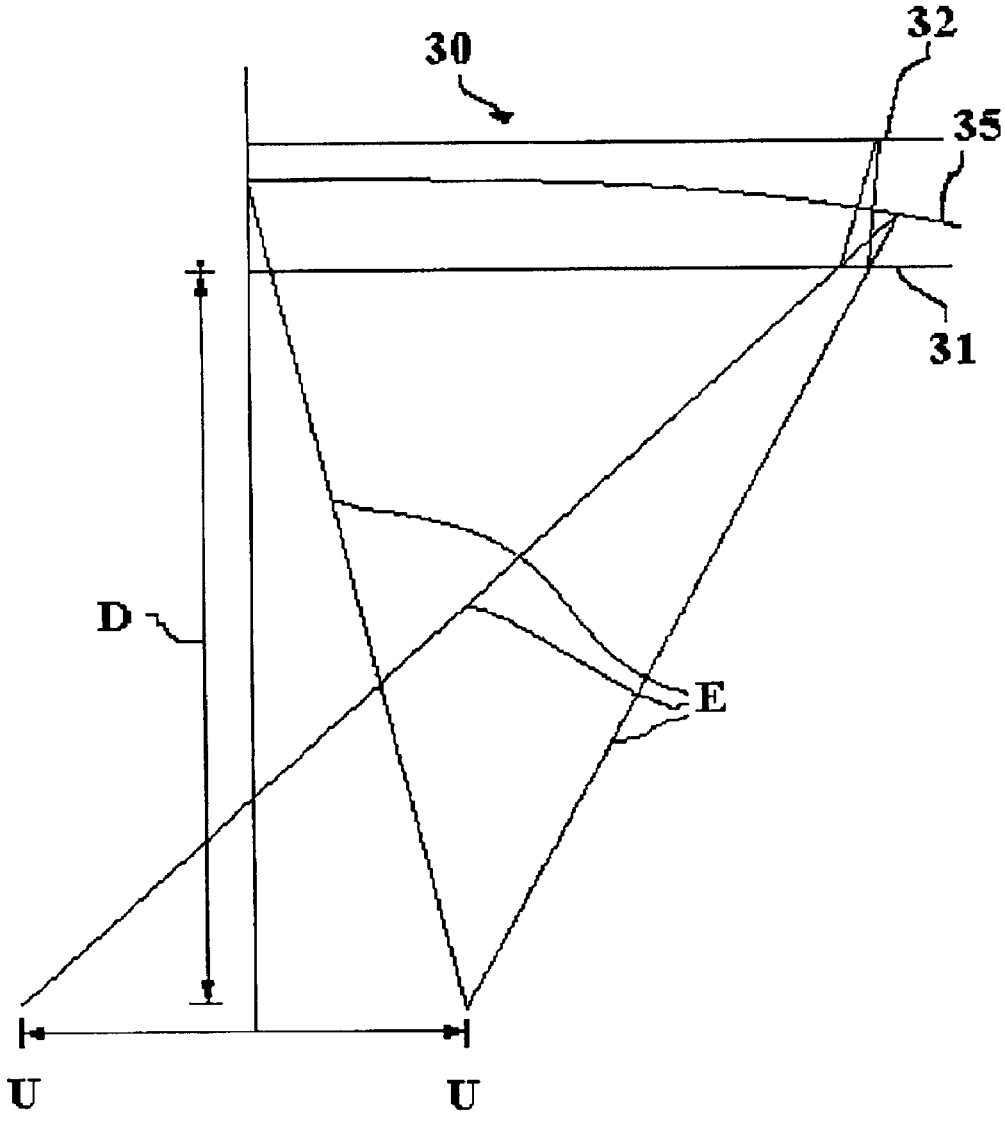
FIG. 4 is a schematic view showing a relationship between a screen image realized on the inner and outer surfaces of the prior art panel and a virtual screen image relative to the viewer's or user's line of vision or sight.

As shown in FIG. 1 and FIG. 2, a flat panel for a cathode ray tube is usually manufactured with a transparent glass plate. The flat panel 20 has an inner surface 22 which is provided with a phosphor surface formed by coating phosphor substances of three colors: red, green and blue, to be uniformly and regularly aligned in the shape of dots, and a non-phosphor substance such as graphite coated between the phosphor substances for preventing degradation of contrast and purity due to external incidental light.

Further, in order to improve the luminance of the phosphor surface, an aluminum thin film is evaporated on the phosphor substances.

The phosphor substances of the three colors: red, green, and blue, are irradiated with electron beams deflected by a deflection yoke, to emit light of corresponding colors, wherein the electron beams are radiated to the corresponding phosphor substances via a shadow mask 25.

The shadow mask 25 is formed of a metal plate of a fine thickness with hundreds of thousands of holes for passing through the electron beams deflected by the deflection yoke. The holes pass only about 20% of the electron beams with the result that the other electron beams collide with the shadow mask 25 and emitted as heat.

The shadow mask 25 is comprised of a mask surface formed by press processing wherein the shadow mask 25 is convexly curved facing the inner surface 22 of the panel. This type of shadow mask is different from an aperture grill or a flat tension mask, in which a mask surface is formed by tension force.

The outer surface 21 of the panel 20 is formed completely flat and reduces reflected light beams for blocking off the external light. On the other hand, the inner surface 22 of the panel 20 is formed to curve convexly but not spherically, facing the outer surface 21 of the panel in order to prevent the refraction of the image as seen along the eye or sight line E of a user U by the outer surface 21 and the distortion of the screen image 23 realized on the phosphor screen by the refraction, so as to realize a natural screen image.

In more detail, when the phosphor substances provided on the inner surface 22 of the panel 20 are irradiated with electron beams and emit light to form the screen image 23, the screen image 23 as seen by the user U at a distance D from the panel 20 does not appear to be located on the inner surface 22 but between the inner surface 22 and the outer surface 21. Also the eye or sight line E of the user U differs in an incidental angle along the central part and the peripheral part of the panel 20. Accordingly, in accordance with a main feature of the present invention, the inner surface is formed non-spherically to prevent the screen image 23 from being shown concavely. This is effected by preventing the screen distortion phenomenon that the screen image 23 is shown concavely by changing the incident angle relative to the viewer's or user's eye or sight line.

The non-spherically formed inner surface 22 of the present invention is formed to satisfy the following formula 1, so as to not distort the screen image 23 to be shown by the user at a distance D apart from the panel 20 as a function of the width of the screen.

$$y_1 \leqq y_2 \qquad \text{(formula 1)}$$

wherein $y_1$ represents a vertical distance between the outer surface and a refracted screen image at a central axis C of the panel 20, and $y_2$ represents a vertical distance between the outer surface and the refracted screen image at peripheral areas that are defined as areas other than the central axis of the panel 20.

As above, the panel 20, in which the outer surface 21 is formed flat and the inner surface 22 is formed non-spherically, has a thickness which increase toward the peripheral areas of the panel in comparison with the central areas of the panel.

Such a difference of thickness between the central areas and the peripheral areas causes a reduction in the luminance along the peripheral areas in comparison with the central areas of the plate 20. In order to resolve the problem, the panel 20 of the present invention is formed of a transparent glass having a transmission ratio of 60% or more.

As above, the flat panel 20 for a cathode ray tube may block off the external light by reducing the amount of reflected light beams and improve the display of screen images.

Further, the inner surface 22, which is formed non-spherically in consideration of the eye or sight lines of a user for the screen image 23 which is refracted while passing through the outer surface 21, prevents the screen image 23 that is formed between the inner surface 22 and the outer surface 21 from being shown to the user U concavely.

As described hereinabove, the flat panel for a cathode ray tube according to the present invention not only blocks off external light by reducing the amount of reflected light by the outer surface but also improves the appearance. The non-spherically formed inner surface makes the screen image realized on the inner surface flat or somewhat convex, thereby achieving a natural image.

The flat panel of the present invention may be used with a variety of existing masks, such as a mask having a mask surface formed by a tension force as in a flat tension mask or an aperture grill mask as well as a mask surface formed by press processing as in the shadow mask, thereby exhibiting superior compatibility over existing cathode ray tubes.

While the present invention has been described and illustrated herein with reference to the preferred embodiment thereof, it will be apparent to those skilled in the art that various modifications and variations can be made therein without departing from the spirit and scope of the invention. Thus, it is intended that the present invention cover the modifications and variations of this invention that come within the scope of the appended claims and their equivalents.

What is claimed is:

1. A flat panel for a cathode ray tube comprising:

a glass having an outer surface and an inner surface;

the outer surface having a flat configuration;

the inner surface having a non-spherical, convexly curved configuration relative to the outer surface and satisfying formula 1, $$Y_1 \leqq Y_2 \quad \text{(formula 1)}$$

wherein $Y_1$ represents a vertical distance between the outer surface and a refracted screen image on a central axis of the panel, and $Y_2$ represents a vertical distance between the outer surface and the refracted screen image in peripheral areas other than the central axis of the panel; and the glass having a first thickness in a central area of the panel and a second thickness in the peripheral areas of the panel, a ratio of the first thickness to the second thickness providing a ratio of transmission in the peripheral areas to that of the central area of 60% or more.

2. In a cathode ray tube comprising a funnel having a neck part and an opening part, an electron gun provided at a front end portion of the neck part in the funnel for emitting electron beams, a deflection yoke for deflecting the electron beams emitted from the electron gun, a shadow mask for discriminating the electron beams deflected by the deflection yoke, and a panel coupled in the opening part of the funnel and provided with a phosphor surface inside for realizing a screen image by the electron beams discriminated by the shadow mask, the panel comprising:

a glass having an outer surface and an inner surface;

the outer surface having a flat configuration; and the inner surface having a non-spherical, convexly curved configuration relative to the outer surface and satisfying formula 1, $$Y_1 \leqq Y_2 \quad \text{(formula 1)}$$

wherein $Y_1$ represents a vertical distance between the outer surface and a refracted screen image on a central axis of the panel, and $Y_2$ represents a vertical distance between the outer surface and the refracted screen image in peripheral areas other than the central axis of the panel; and the glass having a first thickness in a central area of the panel and a second thickness in the peripheral areas of the panel, a ratio of the first thickness to the second thickness providing a ratio of transmission in the peripheral areas to that of the central area of 60% or more.

* * * * *